United States Patent [19]

Roth

[11] Patent Number: 4,989,664

[45] Date of Patent: Feb. 5, 1991

[54] CORE MOLDING COMPOSITION

[75] Inventor: Hilton A. Roth, Cheshire, Conn.

[73] Assignee: United Technologies Corporation, Hartford, Conn.

[21] Appl. No.: 401,532

[22] Filed: Aug. 30, 1989

Related U.S. Application Data

[63] Continuation of Ser. No. 216,490, Jul. 7, 1988, abandoned, which is a continuation-in-part of Ser. No. 18,113, Feb. 24, 1982, abandoned.

[51] Int. Cl.[5] ..... B22C 19/02

[52] U.S. Cl. ..... 164/361; 164/6; 164/469; 501/95; 106/38.9

[58] Field of Search ..... 501/95, 106, 133, 154; 264/DIG. 19; 164/6, 55.1, 520, 528, 525, 529, 361, 369; 106/38.9, 38.27, 38.22

[56] References Cited

U.S. PATENT DOCUMENTS

| | | | |
|---|---|---|---|
| 3,231,401 | 1/1966 | Price . | |
| 3,234,308 | 2/1966 | Herrmann | 264/63 |
| 3,287,476 | 11/1966 | Snyder | 264/36 |
| 3,423,216 | 1/1969 | Somers . | |
| 3,558,591 | 1/1971 | Yendrek | 260/17.2 |
| 3,736,159 | 5/1973 | Gibson et al. . | |
| 3,752,683 | 8/1973 | Hawthorne | 106/55 |
| 3,782,980 | 1/1974 | Smith | 106/57 |
| 3,957,715 | 5/1976 | Lirones et al. | 260/375 B |
| 3,989,533 | 11/1976 | Jago | 106/55 |
| 4,174,331 | 11/1979 | Myles | 260/29.1 R |
| 4,248,752 | 2/1981 | Myles | 260/29.1 R |
| 4,412,804 | 11/1983 | Huther | 425/546 |
| 4,427,742 | 1/1984 | Willgoose et al. | 428/338 |
| 4,464,192 | 8/1984 | Layden et al. | 65/18.1 |
| 4,574,063 | 3/1986 | Scherer | 264/60 |
| 4,602,667 | 7/1986 | Moore et al. | 164/7.1 |
| 4,605,052 | 8/1986 | Morley | 164/16 |
| 4,605,057 | 8/1986 | Sakai et al. | 164/519 |
| 4,818,287 | 4/1989 | Ravins et al. | 164/529 |

FOREIGN PATENT DOCUMENTS

| | | | |
|---|---|---|---|
| 2446273 | 4/1975 | Fed. Rep. of Germany | 164/529 |
| 50-27020 | 9/1975 | Japan | 164/520 |
| 51-16364 | 5/1976 | Japan | 164/520 |
| 58-163543 | 9/1983 | Japan | 164/520 |
| 58-51913 | 11/1983 | Japan . | |
| 61-6184 | 1/1986 | Japan . | |
| 954285 | 4/1964 | United Kingdom . | |
| 1380442 | 1/1975 | United Kingdom . | |
| 2168338 | 6/1986 | United Kingdom . | |

OTHER PUBLICATIONS

Hlavac, J., "Technology of Glass and Ceramics", Elsevier, NY (1983), pp. 244–250.

*Primary Examiner*—Olik Chaudhuri
*Assistant Examiner*—Andrew Griffis
*Attorney, Agent, or Firm*—James M. Rashid; W. J. Sapone

[57] ABSTRACT

A ceramic core molding composition, which includes alumina fibers, zircon, and fumed silica in an amorphous silica base, reduces shrinkage and shrinkage stresses during the core production process. Cores produced utilizing the disclosed composition and method exhibit an improved resistancce to macrocracking over conventionally produced cores.

13 Claims, 1 Drawing Sheet

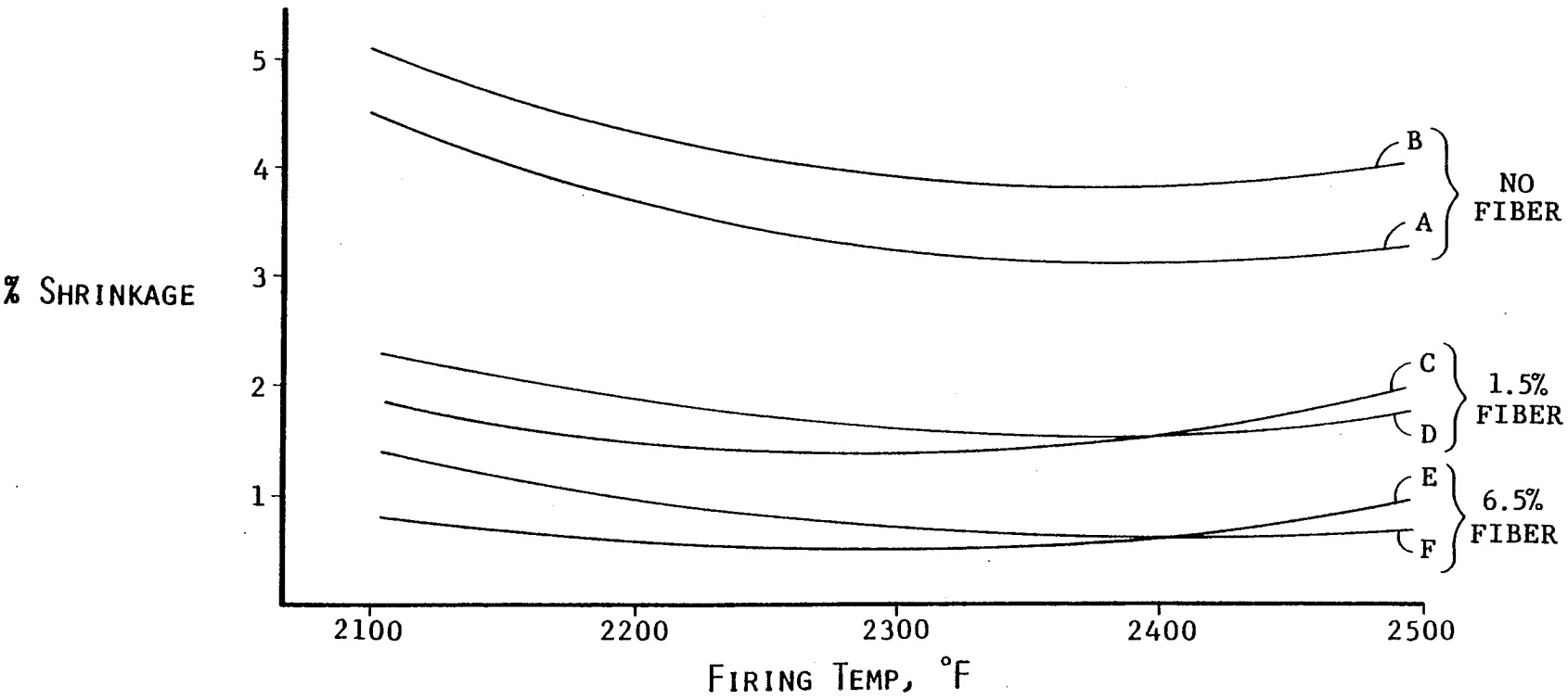
NO FIBER
1.5% FIBER
6.5% FIBER
B
A
C
D
E
F
2500
2400
2300
2200
2100
FIRING TEMP, °F
5
4
3
2
1
% SHRINKAGE

CORE MOLDING COMPOSITION

CROSS REFERENCE

This application is a continuation of U.S. Ser. No. 216,490, filed July 7, 1988, now abandoned, which is a continuation-in-part of U.S. Ser. No. 018,113, filed Feb. 24, 1987 now abandoned. It is related to applicant's copending application titled "Method for Manufacturing Ceramic Cores", filed on even date therewith, U.S. Ser. No. 018,114.

TECHNICAL FIELD

This invention relates to ceramic cores utilized in an investment casting process, and more particularly, to a core molding composition which reduces shrinkage stresses during the core production process.

BACKGROUND ART

Investment casting is extensively used in the production of nickel and cobalt base superalloy blades and vanes for gas turbine engines, particularly those requiring internal cooling holes and passages. The investment casting process produces components having precise dimensional tolerances and excellent surface finishes, both of which are required of gas turbine engine components. In investment casting, a ceramic shell mold is formed around a wax pattern with one or more ceramic cores precisely positioned within the wax pattern, occupying the position of required holes and passages in the casting to be produced. The wax pattern is then removed during a firing operation while the mold and cores remain in place, thus providing a mold cavity. Molten metal is poured into and solidified in the cavity, and the ceramic cores chemically removed such as by leaching with a hot alkali solution The use of removable ceramic cores eliminates the need for machining or drilling operations to produce the required holes and passages, which may be impossible or very difficult to perform on superalloy materials.

Ceramic cores are typically manufactured by injection molding a mixture of ceramic constituents (typically powder particles) and a binder into a green core shape, followed by a firing process to first remove the binder and then to sinter the particles to each other. Generally, chemical additives or mechanical restraints are required to maintain the green core shape and dimensions during the binder removal and sintering processes. In U.S. Pat. No. 3,234,308 to Herrmann, a core composition is disclosed which includes both an organic binder and a thermoset resin. The resin maintains the core shape during the debindering and sintering processes, with the resin burnt out as the core reaches the sintering temperature. Of course, such a composition necessitates additional formation and processing, and may leave additional residue in the core which could cause contamination of the cast metal product.

Efficient debindering is critical to successful ceramic core production. It is essential that debindering be performed at temperatures high enough to minimize the debindering period yet low enough to avoid rapid gas formation or vaporization within the core and subsequent formation of blisters on the core surface. Such constraints usually require that the debindering heat treatment be performed at temperatures lower than the optimum temperature (in terms of kinetics), which extends the debindering period and adds to the cost of producing a core.

In addition to the above mentioned concerns, cracking can occur as the core shrinks by different amounts and along different stress axes during debindering and sintering. In other words, the green cores shrink anisotropically. For example, a core may shrink to a greater degree across its width than across its length, and may shrink more along different planes across its width. The stress produced during the firing process is commonly relieved by the formation of cracks in the core. Two types of cracks have been observed in sintered cores. The most detrimental cracks are termed macrocracks; they are typically visible to the naked eye and reduce the strength of the core. Microcracks are not visible to the naked eye and appear to have little effect on the strength of the core. In general, microcracks are short range cracks confined to small unit volumes within the core. While microcracking may be tolerable and in fact desirable in some circumstances, macrocracking precludes usability of the sintered core in an investment casting process. It is not uncommon in some core producing operations to encounter macrocracks in up to 50% of the ceramic cores produced.

Cores based on amorphous silica have been used in the investment casting of various alloys. Such core systems may also contain zircon, alumina and other materials, and are used because of their stability during casting, low cost and availability of the raw materials. One limitation in the use of amorphous silica based cores is devitrification, i.e., transformation of the amorphous silica into crystalline forms of silica during the firing and casting processes; in particular, amorphous silica transforms into crystobalite, quartz and tridymite, with volume changes accompanying such transformations The volume change associated with the formation of such crystalline forms of silica produces cracks during cooling after the sintering process. Generally, excessive volume changes are avoided by a judicious choice of sintering conditions. In particular, the conditions should be chosen to achieve a crystobalite content of from about 15–30%, by volume. Such amounts of crystobalite produce a sintered core having good mechanical strength. For crystobalite contents greater than about 30% by volume, cores generally are excessively cracked and cannot be used. Therefore, either sintering must be performed at temperatures low enough to avoid the formation of excessive amounts of crystobalite for extended periods of time, or other means must be utilized to inhibit excessive crystobalite formation during core production.

Consequently, what is needed in the art is a core composition which is resistant to shrinkage and the formation of macrocracks associated therewith, and a composition which can be sintered at high temperatures for short periods of time to obtain a desired degree of devitrification.

DISCLOSURE OF INVENTION

It is an object of the present invention to provide a core molding composition with controllable shrinkage properties.

It is a further object of the present invention to provide a core molding composition which limits macrocracking during core production.

These and other objects of the present invention are achieved by utilizing a core molding composition comprising high temperature stable fibers disposed in an amorphous silica based ceramic mixture. The fibers are present in the silica based matrix in an amount sufficient to reduce shrinkage and the macrocracking resulting therefrom. The fibers are stable at temperatures which exceed the sintering and casting temperatures, and are therefore present in the core after the firing and casting processes. The mixture also includes a very fine particle size ceramic material, which is added in an amount sufficient to initiate sintering at low temperatures. The combination of high temperature stable fibers and very fine ceramic particles in the core produce a composition which is readily sintered without the formation of macrocracks.

In a preferred embodiment, the core molding composition comprises from about 1.5 to about 6.5 percent by weight of alumina fiber; up to about 35 percent zircon; up to about 5 percent fumed silica; balance amorphous silica, with a binder and other molding enhancing agents added in amounts sufficient to mold the core and to maintain a core shape during firing. Utilizing the inventive composition, a ceramic core is produced by the steps of mixing the above composition ingredients, molding the mixture to a desired shape, and firing the molded shape such that the binder is removed and the ceramic mixture is sintered.

BRIEF DESCRIPTION OF DRAWINGS

The sole Figure is a graph illustrating the shrinkage that occurs with silica based cores containing no additions of alumina fiber (curves A and B); 1.5% alumina fiber (curves C and D); and 6.5% alumina fiber (curves E and F), with firing times of 1.5 and 5 hours at temperatures of about 1,150° C. and 1,370° C.

BEST MODE FOR CARRYING OUT THE INVENTION

The inventive core molding compound includes a mixture of ceramic particulates as a base. (The term particulate is used in the conventional sense; unless indicated otherwise, the term describes minute separate particles such as powder particles and the like.) For example, a typical ceramic mixture comprises amorphous fused silica and up to about 35 percent by weight zircon powder. A binder is also present in the mixture, in an amount sufficient to mold the core and to maintain the core shape after removal from the core die, and during the debindering and sintering processes. The fused silica particles (and zircon particles, if present) have a relatively coarse particle size with respect to other ceramic constituents in the core. Average particle size of the coarse constituents is about 15 microns.

To provide dimensional stability to the core, and to reduce shrinkage stresses and macrocracking associated therewith, high temperature stable fibers are present in the core composition. Such high temperature stable fibers are herein defined as those capable of surviving the firing and metal casting temperatures intact as fibers; the fibers are stable (physically and chemically) during the debindering, sintering and casting processes. For example, alumina, zircon or silica fibers exhibit the requisite high temperature stability and may be used in the inventive core molding compound. Fibers made of other such ceramic materials may also be useful, as long as they are stable during sintering and casting. The presence of the high temperature stable fibers having a length to diameter (L/D) ratio of between about 250 and 2,500 are useful; in particular, fibers having a length of about 0.25 to about 0.65 centimeters (about 0.10–0.25 inches) and a diameter of about 3–5 microns have been shown to reduce macrocracking and produce cores useful in the investment casting of superalloys. Generally, up to about 6.5% by weight fibers are added to the ceramic mixture; above about 6.5%, the composition becomes difficult to injection mold. At least about 1.5% fibers should be present in the core composition. The typical orientation of the fibers in injected molded cores is generally parallel to the molding axis, although such an orientation does not appear to be required to achieve the benefits associated with the presence of the fibers.

In addition to the ceramic based particulate materials and high temperature stable fibers, a very fine particle size ceramic material should be present in the invention core molding composition. Fumed silica, such as CAB-O-SIL(R) manufactured by CABOT Corporation, Tuscola, Illinois, is an exemplary material having an average particle size of approximately 0.007–0.014 microns and a very high surface area. The surface area of the submicron silica particles is about 300 $m^2/g$, and enables the sintering process to begin at lower temperatures than would otherwise occur with larger sized particles. (The surface area of the coarse, fused silica in the core composition is about 2 $m^2/g$.) As a result of the fumed silica additions, the devitrification of the fused amorphous silica can be more closely controlled to achieve the desired amount of cristobalite in the sintered core.

Sintered cores made in accordance with this invention therefore comprise a mixture of ceramic particulate as a matrix, and high temperature stable fibers dispersed within the matrix. The matrix preferably comprises coarse and fine ceramic particles, and the fibers have a high length to diameter ratio. The matrix can be essentially all silica, but it can also contain additions of other ceramics such as zircon and/or alumina. Additions of up to about 35 percent of such other ceramics are considered to fall within the scope of this invention; the presence of between about 1.5 to about 6.5 percent high temperature stable fibers are necessary to achieve the benefits of this invention.

Preferred ranges of ceramic constituents (i.e., particulate and fibers) are, on a weight percent basis, about 1 to 5 fine silica, 0 to 35 zircon or alumina, 1.5 to 6.5 alumina fiber, balance coarse silica. A more preferred range is about 2 to 4 fine silica, 10 to 35 zircon, 2 to 5 alumina fiber, balance coarse silica. The most preferred mixture of ceramic constituents is about 64 coarse silica, 4 fine silica, 28 zircon and 4 alumina fiber. Coarse silica is considered to be particles in the micron size range (i.e., greater than 1 micron), while fine silica is considered particles in the submicron range. The particle size range of the zircon is preferably similar to that of the coarse silica. The fibers should have an L/D ratio of about 250 to about 2,500.

Referring to the Figure, it is shown that a decrease in shrinkage and therefore a decrease in macrocracking occurs as the amount of fibers employed in the core molding compound is increased. The shrinkage is measured in terms of the amount of linear shrinkage which occurred after firing test specimens having nominal dimensions of about 0.3 cm×0.6 cm×5.7 cm. The ceramic particulate (i.e., matrix) constituents in the cores were amorphous (fused) silica, zircon, and fumed silica, in the approximate amounts set forth in Table I, below; the cores were made in the manner set forth in the Example. With no fibers present in the core, represented by curves A and B in the Figure, the total shrinkage varied from about 3–5 percent; curve A in the Figure represents shrinkage for various cores after about $1\frac{1}{4}$ hours of firing, while curve B represents shrinkage for various cores after about 5 hours of firing. By adding about $1\frac{1}{4}$ weight percent alumina fiber having an L/D ratio of about 635 to the core molding compound (such specimens are represented by curves C and D in the Figure) total shrinkage was reduced to between about $1\frac{1}{4}$ and $2\frac{1}{4}$ percent. The Figure also shows that the presence of the fibers in the core reduced the variation in shrinkage amount due to differing sintering temperatures. By increasing the fiber content to about 6.5%, shrinkage was reduced to between $\frac{1}{4}$ and $1\frac{1}{4}$%, represented by curves E and F in the Figure, with firing times of 1.5 and 5 hours, respectively. While the interaction is not completely understood, the Figure clearly shows that the presence of the high temperature stable fiber in the core mixture produces low shrinkage cores. As a result of the reduction in shrinkage, macrocracks are essentially eliminated. The fibers are stable at high temperatures and survive the debindering and sintering process without decomposing. They also survive the casting process, intact. The fibers do not appear to appreciably increase the overall strength of the cores, based on tensile-type tests conducted on cores containing various amounts of fibers (including tests on cores containing no fibers at all). With the inventive core molding composition, over 95% of the cores produced are dimensionally reproducible, free of macrocracks and, therefore, suitable for use in investment casting.

A typical core production process comprises molding compound preparation, core molding, debindering and sintering. Other processing steps include powder surface treatment, binder preparation, and pelletization of the core molding compound to improve feed flow through a molding machine. Generally, core molding is performed using conventional injection molding equipment, such as either a conventional plunger or screw-type molding machine. While either may be used, best results are generally obtained using a machine with electronic feedback process control of the injection temperature, injection rate and injection pressure. It will be understood by those skilled in the art that molding conditions must be determined by designed experiment techniques. However, molding temperatures between about 80° and 110° C. (between about 180° F. and 230° F.) and pressures between about 140 and 700 kg/cm$^2$ (between about 2,000 psi and about 10,000 psi) are common in the industry and useful in carrying out this invention.

Another key feature of this invention relates to the surface treatment of the ceramic prior to the injection molding process. In particular, the fused silica which comprises the majority of the core molding mixture is at least partially hydrated silica, i.e., has hydroxyl groups attached to the silica surface. The presence of the hydroxyl groups makes the silica difficult to effectively mix and be wetted with the wax binder used in the formation of the green cores. Unless the ceramic is wetted by the binder, the core molding mixture is difficult (if not impossible) to injection mold. To improve the wettability of the silica, the hydroxyl surface groups on the silica particles are reacted with a silane coupling agent prior to injection molding and preferably, prior to mixing with the binder. The surface hydroxyls undergo a condensation reaction with the coupling agent to produce a siloxane bond between the silica and coupling agent. The nonpolar surface produced by adsorption of the coupling agent to the silica is more compatible with the wax binders than are the polar hydroxl groups; as a result, the presence of the coupling agent adsorbed to the silica enhances the wettability of the silica by the binders.

In most circumstances, the addition of about 1–4 weight percent of coupling agent is sufficient to effectively modify the surface characteristics of the silica. Preferably, the minimum amount of coupling agent is added to avoid the introduction of additional chemicals into the core composition. Silane coupling agents are preferred when cores based on silica are made. For best results, the coupling agent is adsorbed on the ceramic constituent mixture prior to mixing with the wax binders.

The wax binder fulfills two requirements: it provides fluidity necessary for injection molding, and imparts sufficient green strength to the core for storage and handling prior to firing. The binder must be present in sufficient quantities to produce a low viscosity ceramic-binder mixture at molding conditions. In other words, the mixture must be readily injection moldable at low injection pressures, e.g., 140–210 kg/cm$^2$.

EXAMPLE

A 2.7 kg (6 pound) batch of the invention core molding composition was prepared for the injection molding of a ceramic core. The proportions of the ceramic particulates and high temperature stable fibers are disclosed in Table I.

TABLE I

| Ingredient | Approximate Concentration Weight Percent |
|---|---|
| zircon | 28 |
| fumed silica | 4 |
| alumina fiber | 4 |
| fused silica | balance |

The fused silica was amorphous, and had an average particle size of about 15 to 16 microns. The zircon had an average particle size similar to that of the fused silica. The fumed silica was generally about 0.007–0.014 microns in size, and had a surface area of about 300 m$^2$/g. The alumina fibers were about 5 microns in diameter and about 0.3 cm in length. The constituents were mixed in a V-blender affixed with an intensifier bar, and once a uniform mixture was obtained, about 2–4 percent by weight of Union Carbide A1108 silane coupling agent was admitted through the intensifier bar into the mixture. The coupling agent had been dissolved in a methanol-water solution, and was heated before addition into the mixture of ceramic constituents.

After blending the ceramic ingredients with the silane coupling agent, the moist powder mixture was dried for three hours at about 80° C. (about 180° F.). The powder was then mixed with a binder in a vacuum sigma mixer. About 13.5% of binder (weight percent based on the combined weight of the ceramic-binder mixture) was added to the ceramic composition. The primary ingredient in the binder was paraffin wax; but the binder also contained materials to prevent flocculation when the binder was mixed with the ceramic constituents, as well as materials which acted as lubricants and plasticizers. Three types of wax were used, which were present in approximately equal amounts: paraffin wax which had a melting temperature of about 55°–58° C. (about 131°–136° F.), paraffin wax which had a melting temperature of about 63°–66° C. (about 144°–149° C.) and mineral wax having a melting temperature of about 73°-78° C. (about 163-172° F.). Deflocculent (oleic acid), lubricant (aluminum stearate) and plasticizer (beeswax) were each present, in amounts based upon the total weight of wax, of about 4, 8, and 9 percent, respectively.

During the mixing of the ceramic constituents and the binder, the importance of the silane coupling agent became apparent. Without the coupling agent, the binder did not readily wet the ceramic constituents; the viscosity of the mixture was quite high, and the mixture was difficult to injection mold. Additions of the coupling agent permitted the surface of the ceramic constituents (in particular, the fused silica particles) to be wetted by the binder; the viscosity of the mixture decreased and its ability to be injection molded dramatically improved. Use of the vacuum mixer assisted the mixing through air removal, promoting intimate contact between the liquid and solid materials. Mixing time was about three hours at a temperature of about 105° C. (about 220° F.). The molding compound was then extruded, pelletized and stored in a low humidity chamber.

Cores were injection molded using a conventional plunger type molding machine and conventional molds. The green cores were then removed from the molds and embedded in alumina sand contained in a firing sagger. The sagger, sand and cores were then placed in a furnace and subjected to a firing cycle which successively accomplished debindering and sintering. Binder removal (and removal of the organic portion of the coupling agent) occurred during a temperature increase from ambient to about 400° C. (about 750° F.) at a rate of about 75° C. (about 135° F.) per hour. The cores were then further heated, up to a sintering temperature of about 1,230° C. (about 2,250° F.) at a rate of about 150° C. (about 275° F.) per hour. The cores were held at the sintering temperature for about three hours and then furnace cooled; after sintering, examination of the cores revealed that the fibers were still intact in the matrix of sintered ceramic particulates. Shrinkage was in the range of about 2 to 2¼ percent. In applicant's copending application titled "Method for Manufacturing Ceramic Cores", the contents of which are incorporated by reference, methods for single cycle debindering and sintering of ceramic cores are more fully discussed.

After the firing cycle, the sintered cores were impregnated with resin to impart additional strength to the core. Polyethylene glycol was the preferred resin used; to promote complete impregnation, the cores were dipped into polyethylene glycol, which was purchased from Union Carbide under the designation Carbowax. Resin impregnation of the cores in this manner was done to impart the cores with additional strength to withstand handling, as well as pattern injection; it had no detrimental effects on the behavior of the cores during the casting process.

Cores made according to this invention have shown their utility in investment casting processes. Metallographic examination of the cores in as-cast hollow gas turbine blades have shown that the cores have successfully formed the desired passages on the internal surfaces of the blade. The fibers were readily apparent in the cores examined in this manner, and the fact that dimensional tolerances were achieved indicates that the cores withstood the firing and casting processes without cracking or distorting.

While the preferred embodiment of the present invention is described in relation to a core molding composition having particular quantities of ingredients it will be understood by those skilled in the art that various changes in the ceramic mixture, molding conditions, firing time and temperatures may be made without varying from the scope of the present invention.

Having thus described the invention, what is claimed is:

1. A method for making an investment casting core, comprising the steps of:

(a) blending a mixture of coarse and fine ceramic particulates with high temperature stable fibers;

(b) mixing the ceramic particulates and fiber with a binder to form a mixture;

(c) prior to said mixing step, treating the particulate to produce thereon a nonpolar surface, wherein said surface is wettable by the binder, and wherein said step of treating produces a low viscosity mixture; and

2. The method of claim 1 further comprising the step of firing the green core to remove the binder and sinter the particulates to each other, wherein the sintered core is characterized by fibers distributed within a matrix of sintered ceramic particulates, exhibits reduced shrinkage during firing, and is substantially free of macrocracks.

3. The method of claim 2 wherein the ceramic particulates are silica and zircon and the high temperature stable fibers are alumina, and wherein the coarse particulates are micron sized and the fine particulates are submicron sized.

4. A ceramic shell mold comprising a sintered ceramic core within the mold, said mold and sintered core defining a mold cavity therebetween, wherein said core comprises about 1.5-6.5 weight percent high temperature stable fibers within a matrix of sintered ceramic particulates.

5. The mold of claim 4, wherein said core comprises alumina fibers within a silica based matrix.

6. The mold of claim 5, wherein said matrix consists essentially of silica and zircon.

7. An investment casting core comprising about 1.5 to about 6.5 weight percent high temperature stable fiber within a sintered ceramic matrix, wherein the core is substantially free of macrocracks.

8. The core of claim 7, wherein the core matrix consists essentially of silica and zircon.

9. The core of claim 7, wherein the core consists essentially of, by weight percent, 1.5-6.5 fiber, 0-35 zircon, balance silica.

10. The core of claim 7, wherein the core consists essentially of, by weight percent, about 1.5-6.5 alumina fiber, 10-35 zircon, balance silica.

11. The core of claim 9, where the core consists essentially of by percent, about 4 alumina fiber, 28 zircon; balance silica.

12. THe method of claim 3, wherein the high temperature stable fibers are present in an amount between about 1.5 and 6.5 weight percent.

13. A method for making a molding mixture particularly adapted for the manufacture of cores for investment casting, the method comprising the steps of:

(a) preparing a mixture consisting essentially of, by weight percent, 1-5 fine silica, 0-35 zircon or alumina, 1.5-6.5 alumina fiber, balance coarse silica;

(b) adding to the mixture formed in step (a) 2-4% of a silane coupling agent, to form a polar surface on the coarse silica; and (c) adding to the mixture formed in step (b) an amount of binder sufficient to produce a mixture which is injection moldable at injection pressures of 140-210 kg/cm$^2$.

* * * * *

UNITED STATES PATENT AND TRADEMARK OFFICE

CERTIFICATE OF CORRECTION

PATENT NO. : 4,989,664

DATED : February 5, 1991

INVENTOR(S) : Hilton A. Roth

It is certified that error appears in the above-identified patent and that said Letters Patent is hereby corrected as shown below:

On the cover page, in the section entitled Related U.S. Application Data, "February 24, 1982" should be:

-- February 24, 1987 --

In column 4, line 16 "O-SIL(R)" should be:

-- O-SIL® --

In column 6, line 68 "(about 144°-149°C.)" should be:

-- (about 144°-149°F.) -- col. 8, line 16

In Claim 1, after paragraph (c), paragraph (d) is missing. The following should be inserted at column 8 between lines 16 and 17:

-- (d) injection molding the particulate, fiber and binder mixture to make a green core. --

In Claim 12, at column 8 line 52, "THe" should be:

-- The --

UNITED STATES PATENT AND TRADEMARK OFFICE

CERTIFICATE OF CORRECTION

PATENT NO. : 4,989,664

DATED : February 5, 1991

INVENTOR(S) : Hilton A. Roth

It is certified that error appears in the above-identified patent and that said Letters Patent is hereby corrected as shown below:

Column 8, line 62, "polar" should read -- nonpolar --.

Signed and Sealed this

First Day of September, 1992

*Attest:*

DOUGLAS B. COMER

*Attesting Officer*

*Acting Commissioner of Patents and Trademarks*